US007821412B2

(12) United States Patent
Fink

(10) Patent No.: US 7,821,412 B2
(45) Date of Patent: Oct. 26, 2010

(54) SMOKE DETECTOR

(75) Inventor: Richard Lee Fink, Austin, TX (US)

(73) Assignee: Applied Nanotech Holdings, Inc., Austin, TX (US)

( * ) Notice: Subject to any disclaimer, the term of this patent is extended or adjusted under 35 U.S.C. 154(b) by 271 days.

(21) Appl. No.: 11/855,767

(22) Filed: Sep. 14, 2007

(65) Prior Publication Data

US 2008/0252473 A1 Oct. 16, 2008

Related U.S. Application Data

(60) Provisional application No. 60/891,927, filed on Feb. 27, 2007, provisional application No. 60/941,858, filed on Jun. 4, 2007, provisional application No. 60/844,761, filed on Sep. 15, 2006.

(51) Int. Cl.
*G08B 17/10* (2006.01)

(52) U.S. Cl. ..... 340/629; 340/628; 340/630; 340/693.6

(58) Field of Classification Search ..... 340/629, 340/628, 630, 632, 634, 693.5, 693.6; 422/68.1, 422/88, 98; 73/23.2; 250/287, 282, 381
See application file for complete search history.

(56) References Cited

U.S. PATENT DOCUMENTS

| | | | | |
|---|---|---|---|---|
| 2,702,898 | A | 2/1955 | Meili | |
| 2,981,840 | A | 4/1961 | Nahmias | |
| 3,078,450 | A | 2/1963 | Bressler | |
| 3,160,866 | A | 12/1964 | Meili | |
| 3,353,170 | A | 11/1967 | Meili et al. | |
| 3,559,196 | A | 1/1971 | Scheidweiler | |
| 3,665,241 | A | 5/1972 | Spindt et al. | 313/351 |
| 3,714,641 | A | 1/1973 | Scheidweiler | |
| 4,238,788 | A * | 12/1980 | Rosauer et al. | 340/515 |
| 4,364,031 | A | 12/1982 | Scheidweiler et al. | |
| 5,455,417 | A | 10/1995 | Sacristan | |
| 5,847,509 | A | 12/1998 | Wuest | |
| 6,958,475 | B1 | 10/2005 | Colby | |
| 2002/0142477 | A1 | 10/2002 | Lewis et al. | 436/151 |
| 2005/0098720 | A1 | 5/2005 | Traynor et al. | |
| 2006/0099715 | A1 | 5/2006 | Munoz et al. | 436/151 |
| 2007/0029477 | A1 | 2/2007 | Miller et al. | |
| 2008/0159924 | A1 * | 7/2008 | Fink | 422/186.3 |

OTHER PUBLICATIONS

D. Riley et al., "Helium Detection via Field Ionization from Carbon Nanotubes," *Nano Letters*, vol. 3, No. 10 (2003) 1455-1458.

M. Peterson et al., "Low-voltage Ionization of Air with Carbon-based Materials," *Plasma Sources Sci. Technol.*, vol. 14 (2005) pp. 654-660.

(Continued)

*Primary Examiner*—Toan N Pham
(74) *Attorney, Agent, or Firm*—Kelly Kordzik; Matheson Keys Garsson & Kordzik PLLC

(57) ABSTRACT

A smoke detector replaces the americium source of alpha particles with a field emission device using carbon nanotubes as the field emitters, or some other field emitter, in order to provide an ionization of the air potentially caring smoke particles through the smoke detector.

26 Claims, 14 Drawing Sheets

OTHER PUBLICATIONS

C. Dong et al., "Carbon Nanotube Electron Source Based Ionization Vacuum Gauge.," *Appl. Phys. Lett*., vol. 84, No. 26 (2004) pp. 5443-5445.

A. Modi et al., "Miniaturized Gas Ionization Sensors Using Carbon Nanotubes," *Nature*, vol. 424, (2003) pp. 171-174.

B. Yan et al., "Effects of Argon Plasma Treating on Surface Morphology and Gas Ionization Property of Carbon Nanotubes," *Physica E*, vol. 28 (2005) pp. 88-92.

N. Koratkar, "Nanoscale Field Ionization Sensors: A Review," *Intl. Jnl. of Nanoscience*, vol. 4, Nos. 5 & 6 (2005) pp. 945-949.

J. Singh et al., Field Ionization of Argon using β-Phase W Nanorods, *Appl. Phys. Lett*., vol. 85, No. 15 (2004) pp. 3226-3228.

I. Choi et al., "Application of Carbon Nanotube Field Emission Effect to an Ionization Gauge," *Appl. Phys. Lett*., vol. 87 (2005) pp. 173104-1-173104-3.

E. Müller, "Field Desorption," *Physica Review*., vol. 102, No. (1956) pp. 618-624.

R. Gomer, *Field Emission and Field Ionization* (1993) pp. 1-191.

L. Thuesen et al., "Field Emission Carbon Thin and its Lifetime Stability," *J. Vac. Sci. Technol. B*, vol. 18, No. 2 (2000) pp. 968-971.

S. Berber et al., "Usually High Thermal Conductivity of Carbon Nanotubes," *Physical Review Letters*, vol. 84, No. 20 (2000) pp. 4613-4616.

M. Yu et al., "Tensile Loading of Ropes of Single Wall Carbon Naotubes and Their Mechanical Properties," *Physical Review Letters*, vol. 84, No. 24 (2000) pp. 5552-5555.

T. Tonegawa et al. "Development of Large Size CNT-FED," *Proc Int. Disp. Workshops*, vol. 12, No. 2, (2005) pp. 1659-1662.

International Search Report mailed Mar. 13, 2008, Application No. PCT/US07/78530, 10 pages.

International Preliminary Report on Patentability, PCT/US2008/054425, Sep. 3, 2009, 9 pages.

* cited by examiner

SMOKE DETECTOR

This application for patent claims priority to U.S. Provisional Patent Applications Ser. No. 60/891,927 filed Feb. 27, 2007, Ser. No. 60/941,858 filed Jun. 4, 2007, and Ser. No. 60/844,761 filed Sep. 15, 2006 which are hereby incorporated by reference herein.

BACKGROUND

Current smoke detector technology is based on one of two general approaches. Photoelectric-based detectors are based on sensing light intensity that is scattered from smoke particles. Light from a source (LED) is scattered and sensed by a photosensor. When the sensor detects a certain level of light intensity, an alarm is triggered. Ionization-type smoke detectors are based on a radioactive material that ionizes some of the molecules in the surrounding gas environment. The current of the ions is measured. If smoke is present, then smoke particles neutralize the ions and the ion current is decreased, triggering an alarm.

Referring to FIG. 1, ionization sensor smoke alarms 100 contain a small amount of radioactive material, americium 101, embedded in a gold foil matrix within an ionization chamber 103. The matrix is made by rolling gold and americium oxide ingots together to form a foil approximately one micrometer thick. This thin gold-americium foil is then sandwiched between a thicker (~0.25 millimeter) silver backing and a 2 micron thick palladium laminate. This is thick enough to completely retain the radioactive material, but thin enough to allow the alpha particles 102 to pass.

The ionization chamber 103 is basically two metal plates 104 a small distance apart. One of the plates 104 carries a positive charge, the other a negative charge. Between the two plates 104, air molecules received through the screen 105, made lip mostly of oxygen and nitrogen atoms, are ionized when electrons are kicked out of some molecules and picked up by other molecules as a result of collisions with alpha particles 102 from the radioactive material 101. The result is oxygen and nitrogen molecules that are both positively and negatively charged, such as $NO^+$, $O_2^-$, $OH^-$, $HCO_3^+$, and many other similar ions.

FIGS. 1 and 2 illustrate how ionization technology works. Referring to FIG. 1, the positive atoms flow toward the negative plate, as the electrons or negative ions flow toward the positive plate. The movement of the charges registers as a small but steady flow of current. Referring to FIG. 2, when smoke particles 106 enters the ionization chamber 103, the current is disrupted as the smoke particles 106 attach to the charged ions and restore them to a neutral electrical state. The large smoke particles 106 can shield the electric charge due to their size, or neutralize the charge through a chemical reaction. The net result is that fewer charged ions make it to the electrode. This reduces the flow of current between the two plates 104 in the ionization chamber 103. When the electric current drops below a certain threshold, an alarm is triggered.

There are problems with the radioactive material that is currently used as an ionizer.

1. The radioactive material is a small amount and does not pose a health hazard to the homeowner as long as the material is not tampered with. It is possible that someone could tamper with the americium-based smoke detector and inadvertently inhale or ingest the americium. This can be a serious health hazard.

2. Although the amount of americium in each smoke detector is small (about 1 microCurie), the accumulated amount of material can add up. The typical user disposes of the smoke detector by throwing it in the household trash. It is possible that this material can then find its way into recycled material that could then find its way back into a home in a form that is not so innocuous as the original smoke detector.

DETAILED DESCRIPTION

Embodiments of the present invention replace the radioactive element of the standard ionization-type smoke detector with a field emission or field ionization ion source that is non-radioactive and uses no radioactive materials. The field emission ion source will operate at atmospheric pressures and will operate over a wide temperature range. What is described in detail below are embodiments that use carbon nanotubes as the field ionizer material, but there are many other materials that could be used for this application:

1. Functionalized or coated carbon nanotubes may be used to improve durability and lifetime and also reduce operating voltage. One example of this would be alkali-metal coated or alkali-salt coated carbon nanotubes.

2. Nanotubes or nanowires of other materials, such as Si, ZnO, GaAs, etc. These nanowires may also be functionalized or coated.

3. Metal or semiconducting microtips may be used, such as W or Mo (metals) or Si or Ge (semiconductors). It may be possible that a Spindt microtip configuration may be used with an emitter structure and a gate electrode.

An electric field on the order of several megavolts/cm (~several 100 V/μm) is sufficient to produce electron emission from materials. One way to achieve these fields practically is to use conducting or semiconducting structures, or materials that have very high aspect ratios (they are tall and thin), and place them in an electric field. Because the high aspect ratios will concentrate the electric fields at the ends or tips of the structure, electron field emission can be achieved with applied electric fields as low as 1-10 V/μm since the electric field at the tips of these high aspect features can be as high as 100-1000 V/μm.

Figure 3A:
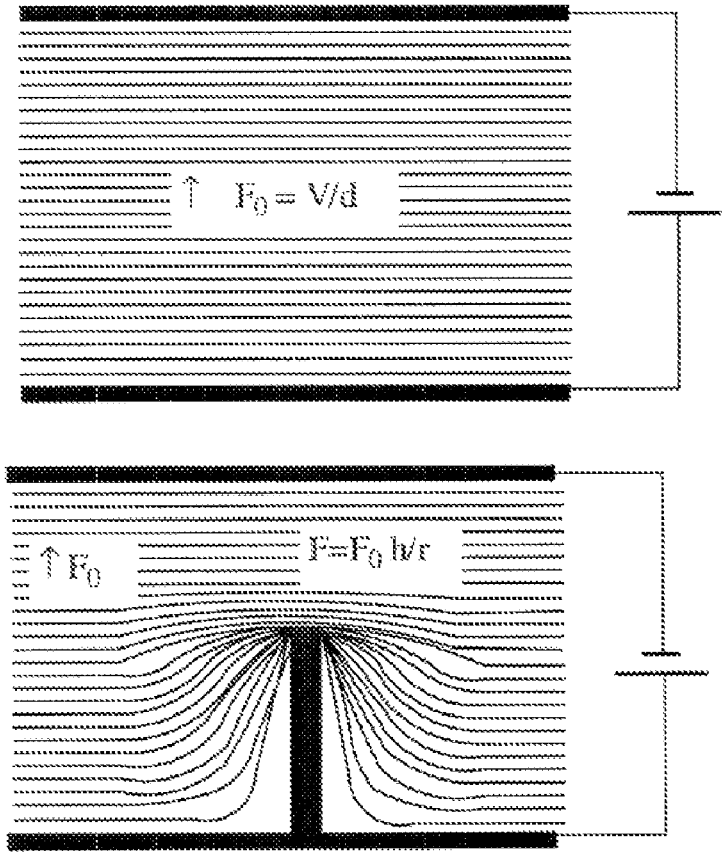
FIG. 3A demonstrates an effect of an electric field at a point source.
Figure 3B:
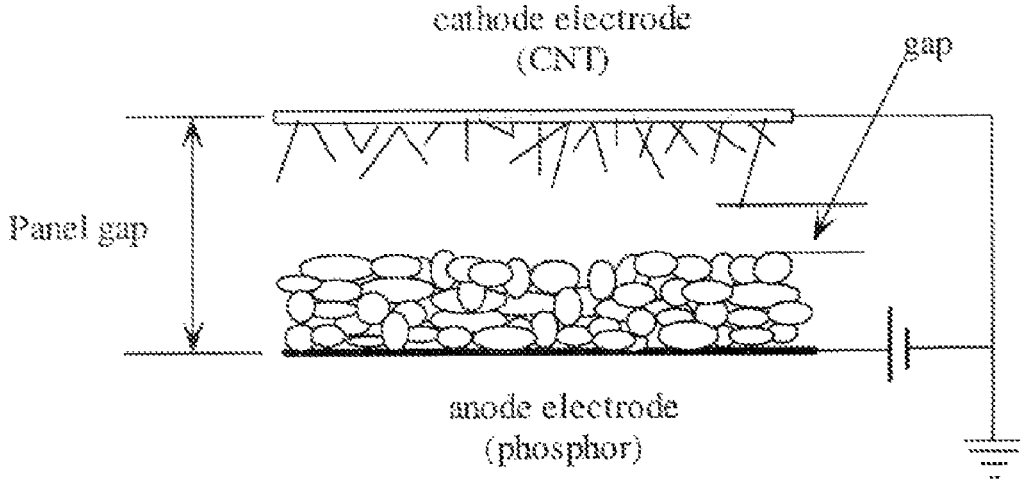
FIG. 3B illustrates a field emission device.

FIG. 3A illustrates how a high aspect ratio (h/r) conductor concentrates the applied electric field ($F_0$) so that the field at the tip of the conductor (F) is magnified. FIG. 3B illustrates a diode-type (anode sued cathode electrodes only) field emission display structure using carbon nanotube emitters. See, Tonegawa et al., "Development of Large Size CNT-FED," IDW/AD '05, Takamatsu, Japan, p. 1659.

Initially, metal or Si microtip structures were designed and built to be used for field emission applications. See, C. A. Spindt and L. N. Heynick, U.S. Pat. No. 3,665,241, May 23, 1972. The first field ionization experiments were performed by Müller. See, E. W. Müller, Phys. Rev. Vol. 102, p. 618 (1956). There are two cases or methods to use field emitter structures as gas ionization sources:

Case 1) Electrically bias the structures negatively such that electrons are pulled from the field emitters into the gas environment (producing ions by electron-impact or electron capture); or Case 2) Electrically bias the structures positively (the reverse of above) such that electrons are pulled from the gas molecules into the tips of the structures, thus producing positive ions.

In both cases, it is well documented (See, Robert Gomer, Field Emission and Field Ionization, pub. by the Am. Inst. of Physics, 1993, pp. 1-31 and 64-102) that the phenomenon that controls the behavior is quantum mechanical tunneling of electrons from the conduction band of the metal into the vacuum or gas environment as a result of high local electric fields (Case 1), or the reverse, electrons tunneling from the gas molecules into the metal (Case 2) from similar applied electric fields but polarized in the opposite direction.

There are issues that are considered for implementing embodiments of the present invention:

Gas adsorption and changing work function of the tip emitters: Since these emitters will operate in air, gas can form physical and chemical bonds to the surface, changing work function and aspect ratio and degrading emission properties. Carbon nanotubes are relatively inert compared to most metals (i.e., an oxide layer is not formed on the surface). They are flexible yet strong, (Young's Mod. of SWNT=1 TPa, max tensile strength=30 GPa. See, M.-F. Yu et al., Phys. Rev. Lett. 84, 5552 (2000)) and have high thermal conductivity. See, Savas Berber et al., "Unusually High Thermal Conductivity of Carbon Nanotubes", PRL, V84, p. 4613, (2000). Based on these properties, the carbon nanotube is a good choice, as it is expected to be the most stable.

Ion erosion of the emitter: Water or oxygen ions may attach to the carbon nanotube material, converting it to CO or $CO_2$. This may limit the life of the carbon emitters. It is found that this is true in high vacuum conditions. See, L. H. Thuesen, R. L. Fink, et al., J. Vac. Sci. Technol. B 18(2), p. 968, March/April 2000. For embodiments herein, the electrons are emitted into air at atmospheric pressure at low energy; thus, the electrons do not gain significant energy before impacting a molecule. Therefore, ions are created by electron capture (i.e., they are negative ions) and are repelled from the CNT electrode. The only concern may be positive ions. Positive ions can be created if the electron energy striking the molecule is high. Embodiments herein may adjust both the gap between the electrodes and the bias of the electrodes to change the electron impact energy and tune it for optimal performance. Furthermore, the impact of ions on the CNT emitters may be limited because ion energy will be imparted to other molecules as a result of high collision rates at atmospheric pressure.

There are examples of using carbon emitters as gas ionization sources in the literature. Dong et al. and Choi et al. used CNT emitters in ionization vacuum gauges. See, C. Dong et al., APL., 84, p. 5443, 2004, and In-Mook Choi, et al., APL., 87, p. 173104, 2005. They operated their devices in partial vacuum, different from the proposed approach, and with much higher electron impact energy than proposed herein. Riley et al. used multiwall carbon nanotubes to ionize He. See, D. J. Riley et al., "Helium Detection via Field Ionization from Carbon Nanotubes," NanoLetters, 3, p. 1455 (2003). They were successful in ionizing He atoms at low pressures ($4\times10^{-5}$ mbar).

Peterson et al. measured the performance of both carbon nanotubes and polycrystalline diamond as a gas ionizer at atmospheric pressure and in the Case 1 mode, very similar to what is disclosed here. See, M. S. Peterson, W. Zhang, et al., Plasma Source Sc. and Technol., Vol. 14, pp. 654-660. (2005). First, using the highly graphitic polycrystalline diamond material, they were able to generate a current between 5 pA and 10 μA with voltages of 20 V and 340 V respectively, using a gap of 10 μm. They were able to maintain the current in one case over 40 hours in continuous DC mode. This demonstrates that oxygen ions did not significantly degrade the performance of the carbon-based electron source operating in air.

Figure 4A:
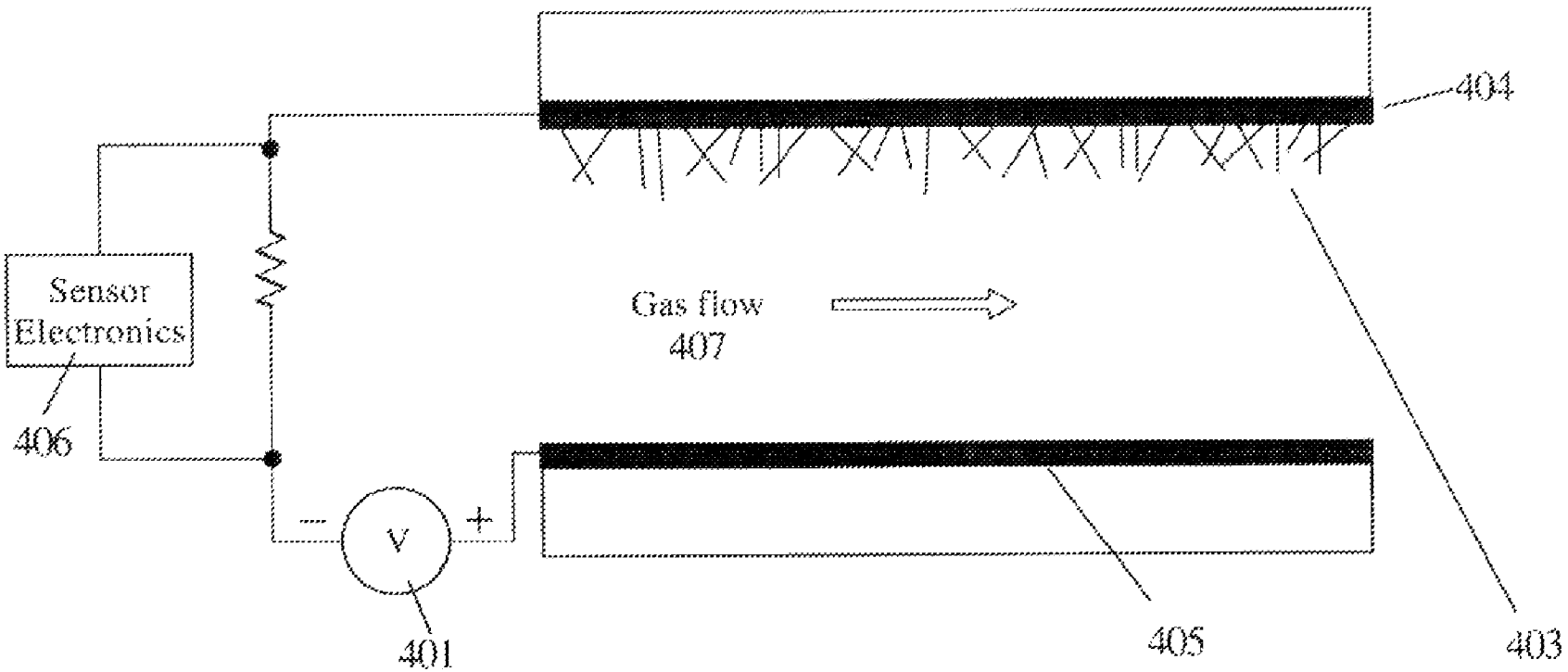
FIG. 4A illustrates a smoke detector.

FIG. 4 illustrates a first embodiment, which may be easiest to make and may be the lowest cost to manufacture of all the designs. It comprises two conductor plates or metal coated glass panels 404, 405. One conductor 404 is coated with CNTs 403. Air 407 is allowed to flow in between the plates 404, 405. Either DC or AC voltage may be applied between the electrodes. It is also possible to bias die electrodes with an AC voltage having a DC offset. In DC mode or with a DC offset, ions created will drift toward an electrode; the direction of the drift will depend on the charge of the ion. An alternative (not shown) is that both sides may be coated with a CNT film to take advantage of the AC swing that may be needed to neutralize ion drift. The substrates are shown as glass that is metallized. It in fact may also be a metal foil or other conducting sheet of material. Gas may be forced through the gap in one direction or there may be no forced flow at all and left open to the prevailing air currents in the room, entering the gap from any direction. Sensor electronics 406 are coupled to the electrodes 404, 405 to detect changes in the current and set off an alarm if a threshold of smoke particles are detected.

Figure 4B:
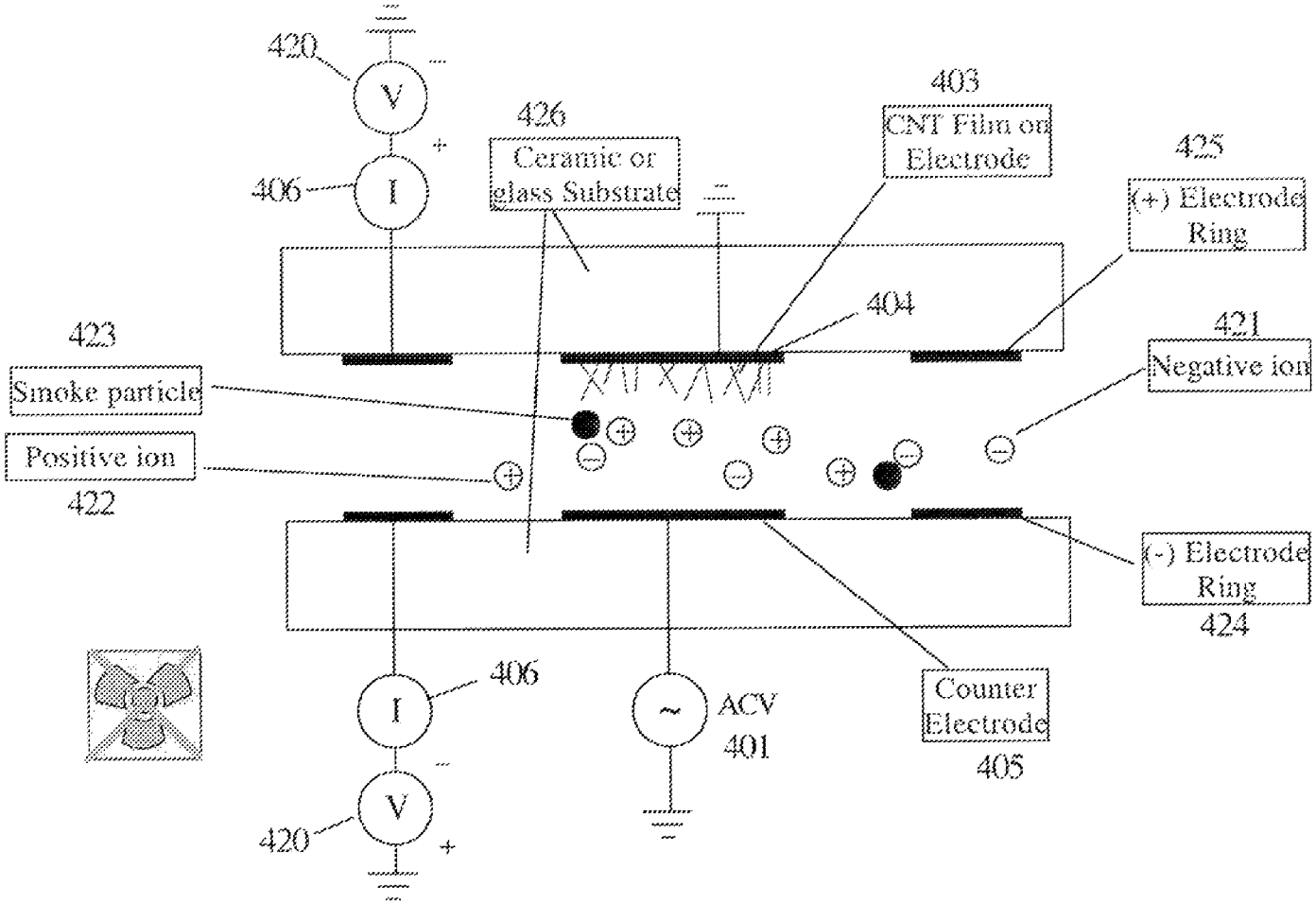
FIG. 4B illustrates another embodiment of a smoke detector.

FIG. 4B illustrates a second embodiment that is similar except the sensor electrodes (electrode rings 424 and 425) are separate and independent of the gas ionization electrodes (404 and 405) although they may be formed or deposited onto the same substrate 426. The substrate material in this case is insulating, such as ceramic materials or glass. In this embodiment, ions are created in a similar manner as in FIG. 4, but here the ion current is measured by collecting the negative ions oil the positive electrode (425) and by collecting the positive ions oil the negative electrode (424). These electrodes can be various shapes and sizes but they are in close proximity to the ion source so that they measure the ions created in the gap between electrodes 404 and 405. As described before, the parameters of the ion source electrodes can be adjusted to create positive ions, negative ions or both. Sensor electronics 406 are coupled to the electrodes 424 and 425 to detect changes in the current and set off an alarm if a threshold of smoke particles is detected.

Figure 5:
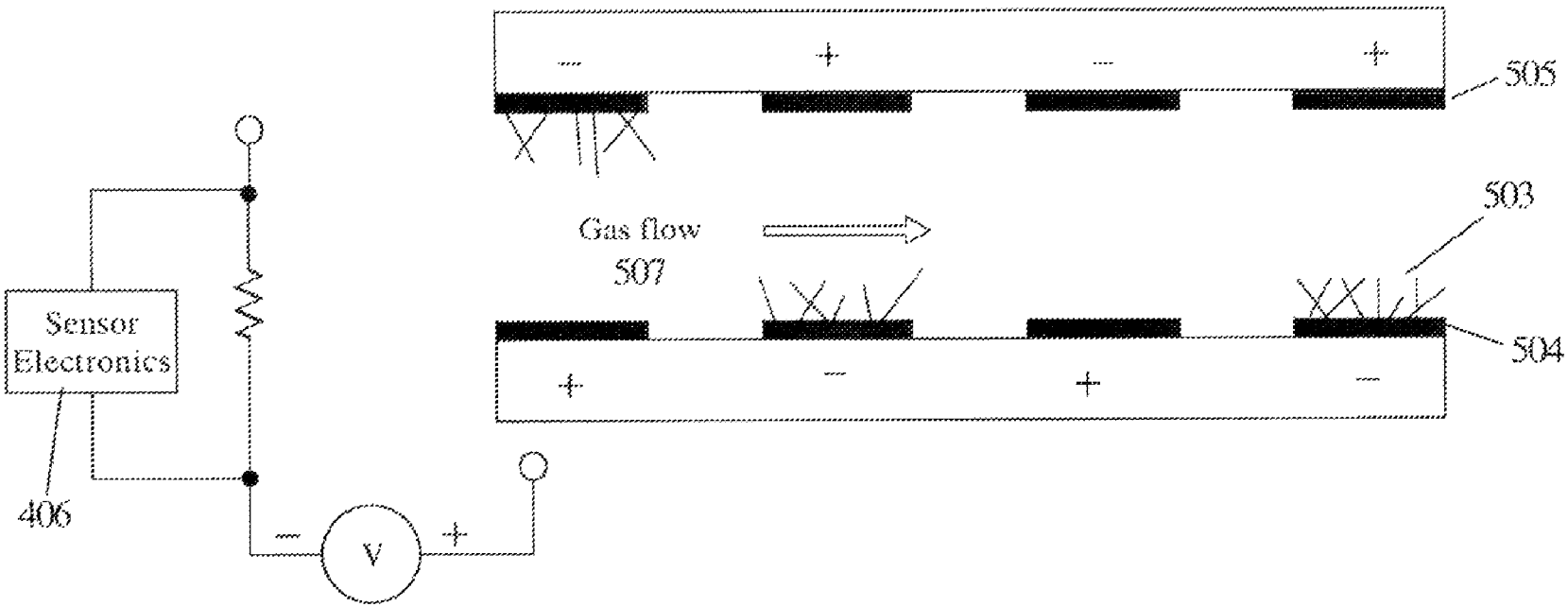
FIG. 5 illustrates another embodiment of a smoke detector.

FIG. 5 illustrates a third embodiment that is similar except it has a smaller area and thus the capacitance will be lower. The + and − lines may be easily patterned using standard photoresist-patterned metal lines 504, 505 on glass substrates, or by screen printing. Design factors, such as the gap between electrode plates and the spacing between the electrodes on the same plate, may be varied. The drive parameters, such as the bias level, frequency and duty factor, may be easily varied to achieve optimal conditions. The electrodes 504, 505 may be operated in DC or AC mode, or in an AC mode with a DC offset. In this design, an insulating substrate may be required to maintain the potentials on the separate electrodes. Gas 507 may be forced through the gap in one direction or there may be no forced flow at all and left open to the prevailing air currents in the room, entering the gap from any direction. A CNT coating 503 is deposited on the electrodes 504, 505 in a desired manner.

Figure 6A:
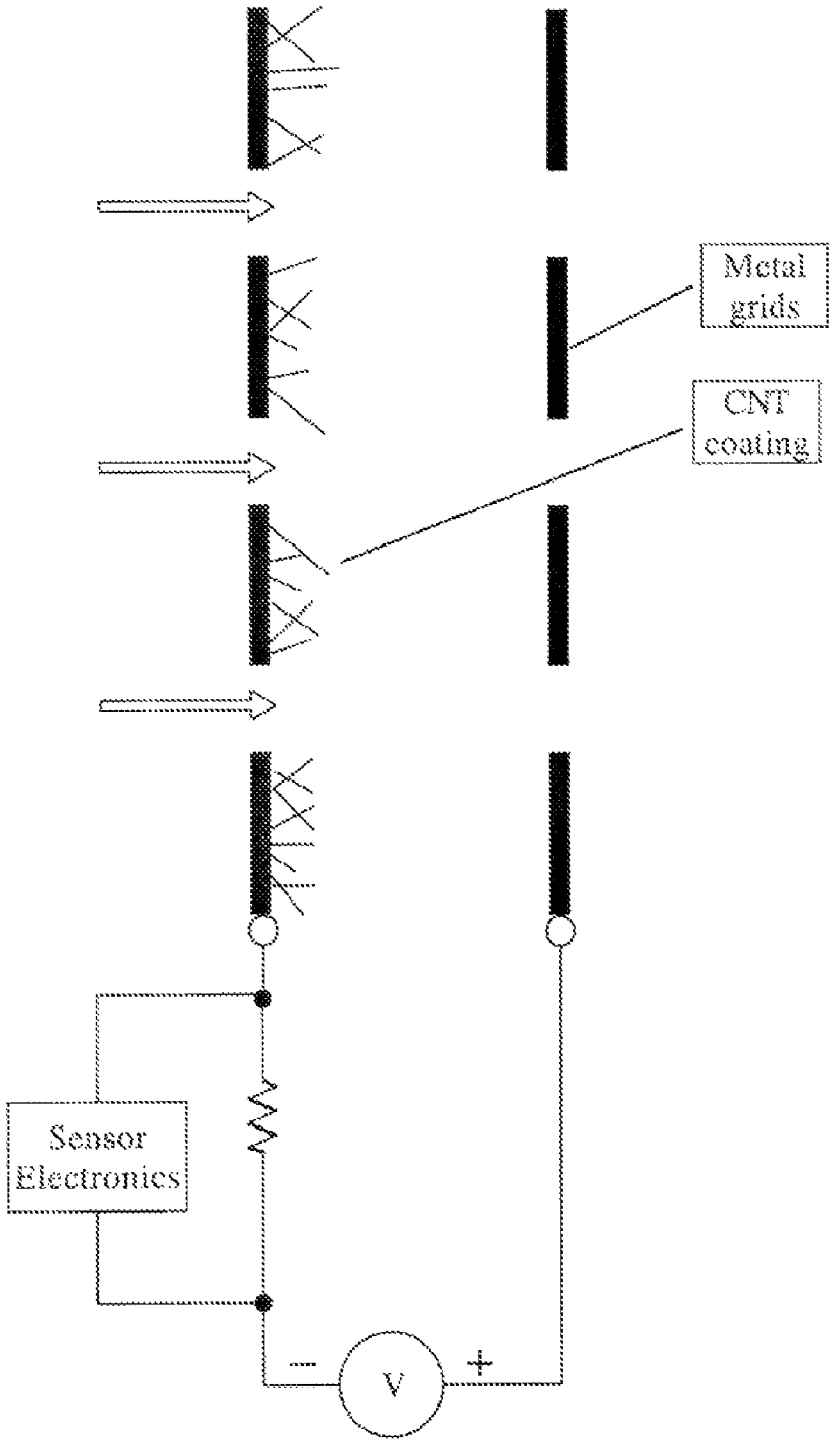
FIG. 6A illustrates another embodiment of a smoke detector.

FIG. 6A illustrates two metal grids 601, 602 that are parallel to each other; one or both may be coated with CNTs 603. If the other grid is coated, then the coating would face the coating on the other grid. The gas flow 607 is through the grids 601, 602. Once the grid material is chosen, the only mechanical parameter that may be changed is the gap between the grids 601, 602. As with extraction grids used for vacuum microelectronics, such as displays and x-ray tubes, a good rule of thumb is that the grid dimension (size of grid openings) is about the same as the gap between the grids. The metal grids 601, 602 or electrodes may be operated in DC or AC mode, or in an AC mode with a DC offset. The drive parameters, such as DC voltage bias level, AC or DC potential and frequency of AC signal may also be optimized. This design allows for easy flow of gas through the grid.

Figure 6B:
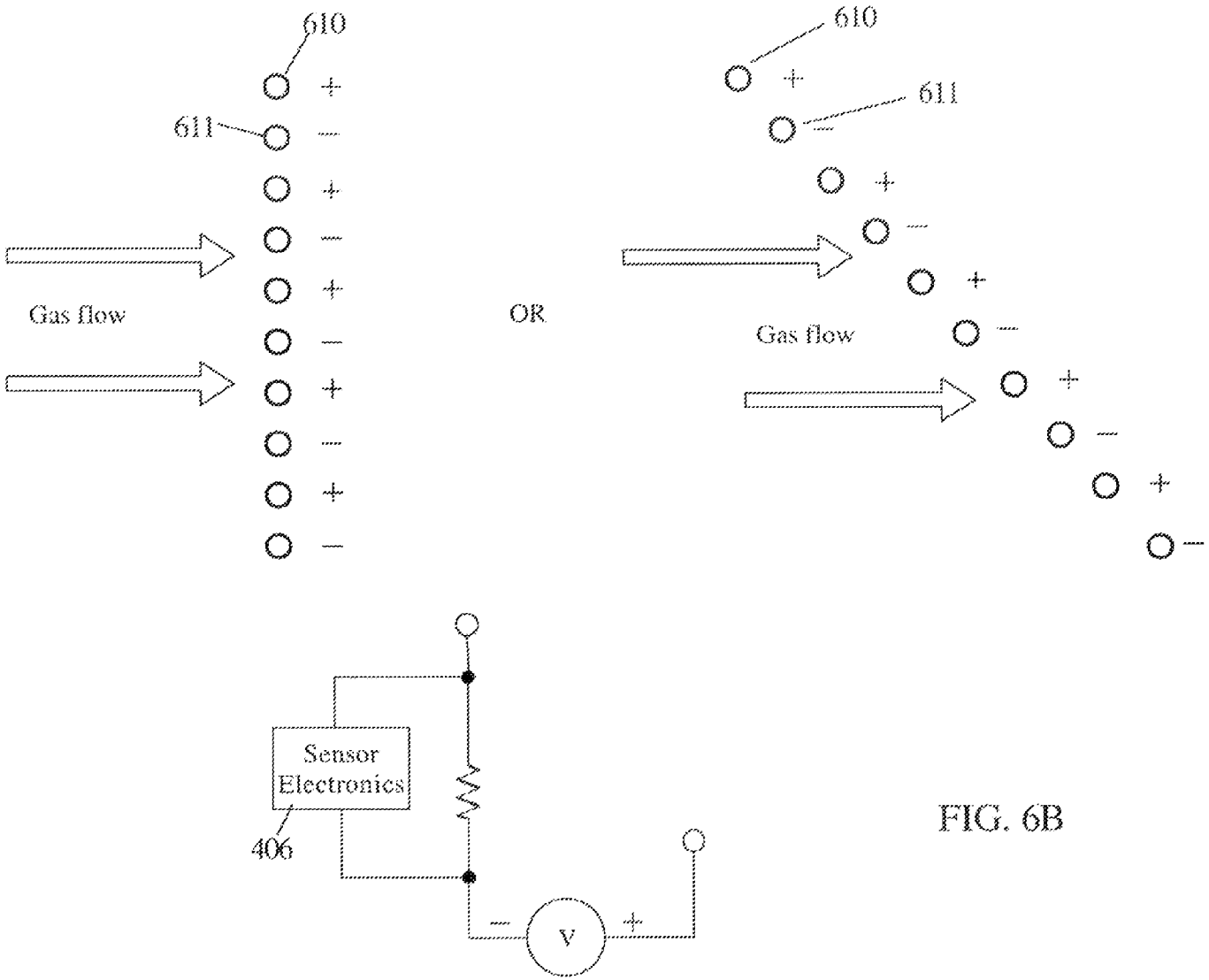
FIG. 6B illustrates another embodiment of a smoke detector.

FIG. 6B illustrates an embodiment similar to the embodiment illustrated in FIG. 6A except there is only one "grid" that comprises CNT coated wires 610, 611 that are biased relative to each other.

Figure 7:
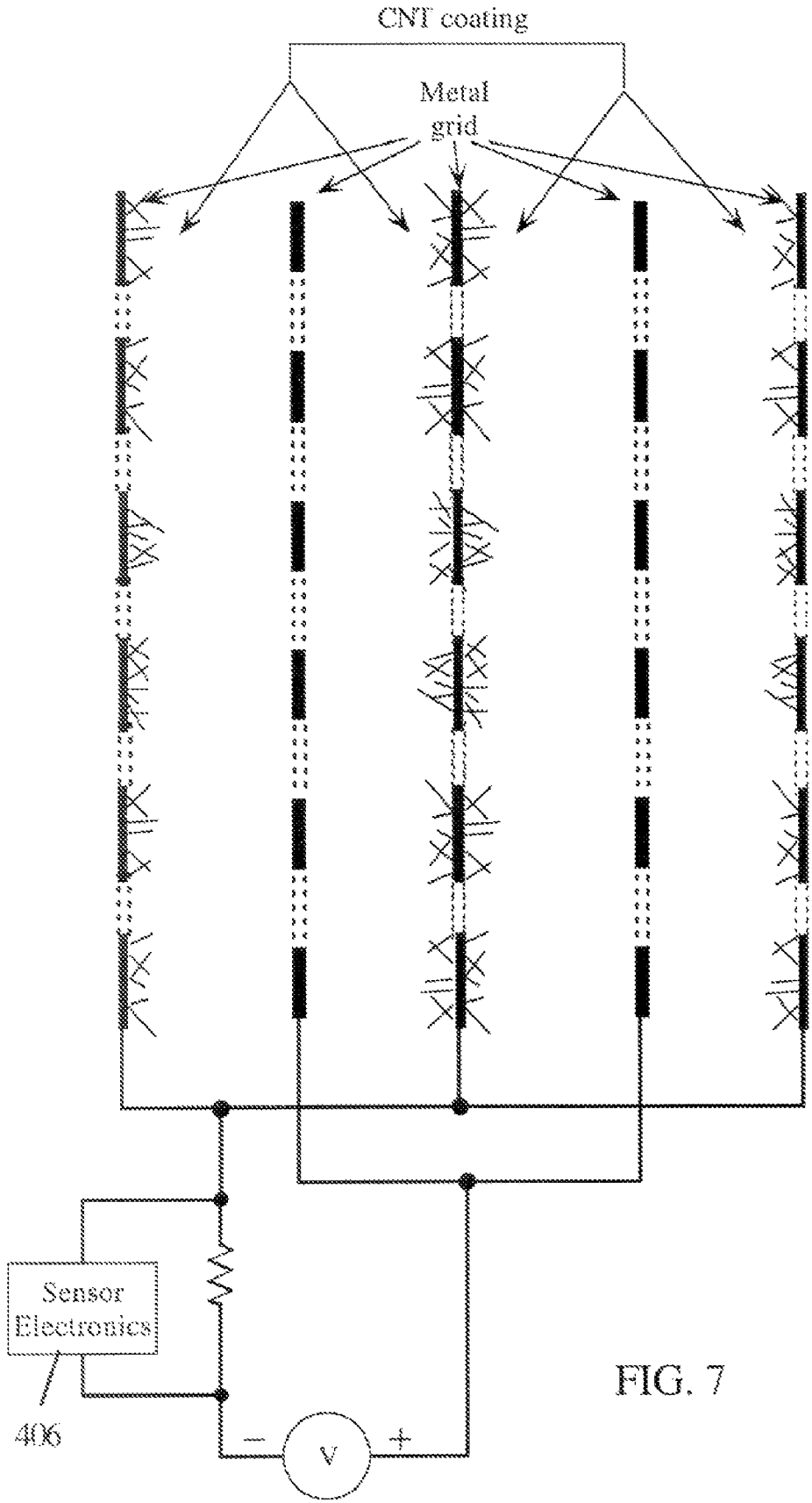
FIG. 7 illustrates another embodiment of a smoke detector.

Referring to FIG. 7, several grids may be used, spaced apart from each other similar to the 2-grid design shown in FIG. 6A. The grids may be biased opposite each other (+ then − then + and so on). FIG. 7 shows the CNT coating on selected surfaces, but the CNT coating may be on both sides of the grid. The bias between the grids may be DC, or it may be AC or could be AC with a DC offset.

The embodiments described herein detect smoke in the same way that the prior art detects smoke, but from monitoring the change in current through one or more of the grids or electrodes. For example, if electrons are emitted into the gas on a negative electrode, this would create negative ions that would be collected at the positive grid or electrode. However, if there is smoke present, then the negative ions may react with the smoke particles (typically carbon particles or hydrocarbon aerosols) and neutralize or mask the negative charge to create neutral particles; thus no current would arrive at the positive electrode. The current at each electrode may be monitored, and if a current decreases below a set value, an alarm may be triggered.

Figure 1:
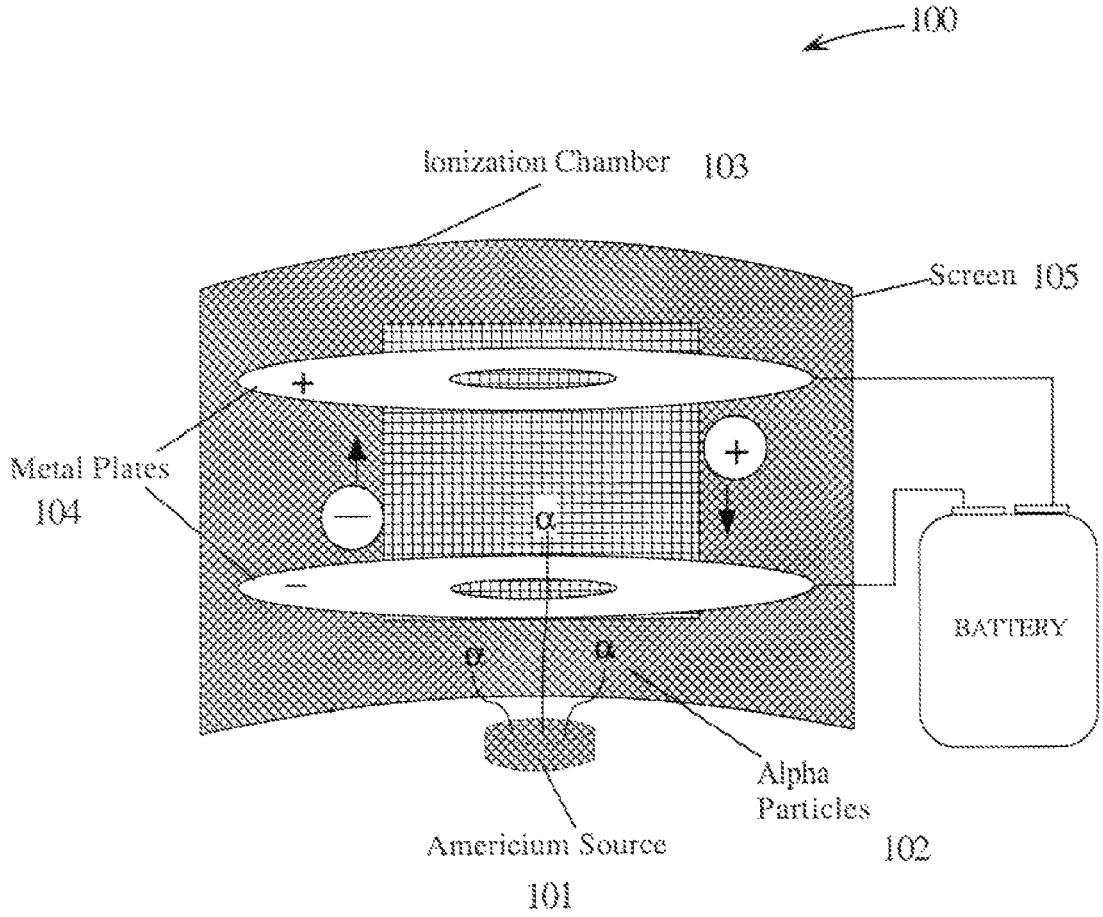
FIGS. 1 and 2 illustrate a prior art smoke detector.
Figure 2:
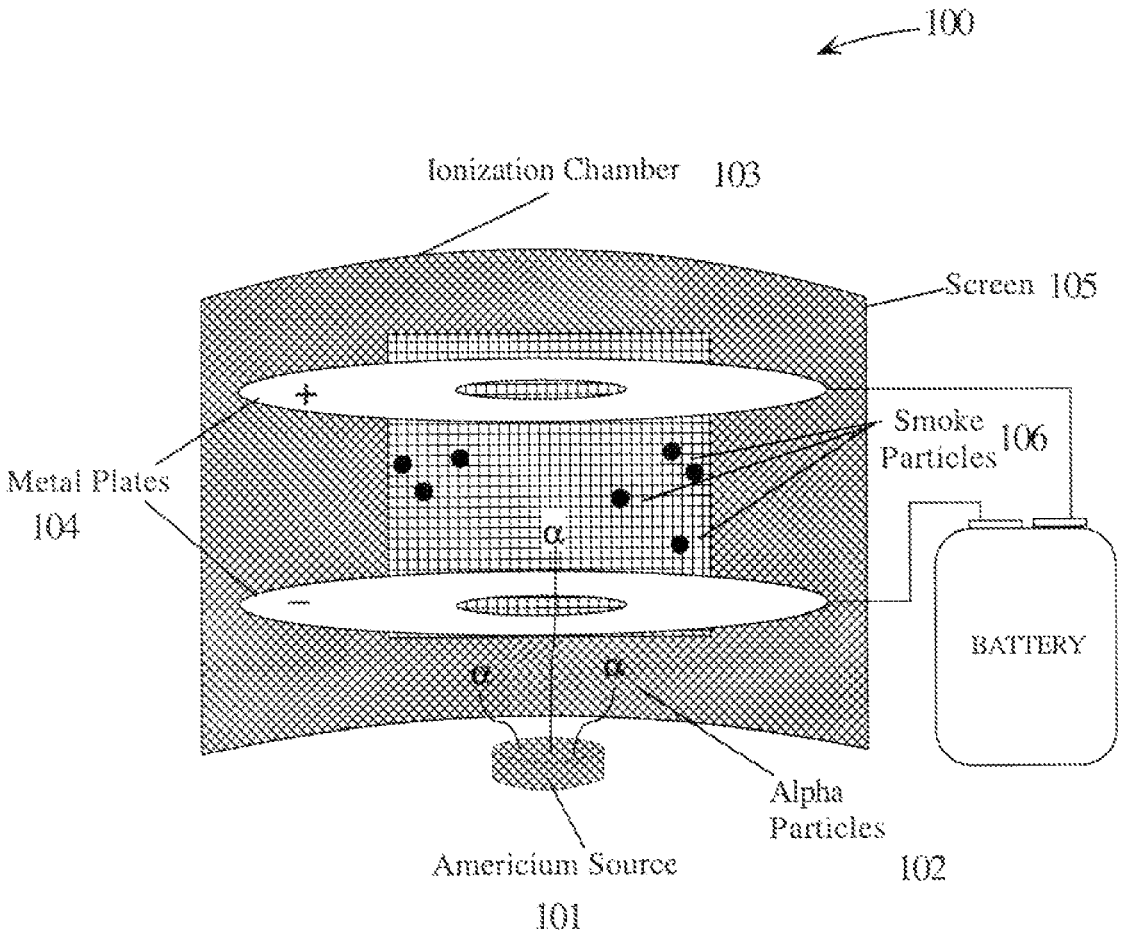
Figure 8:
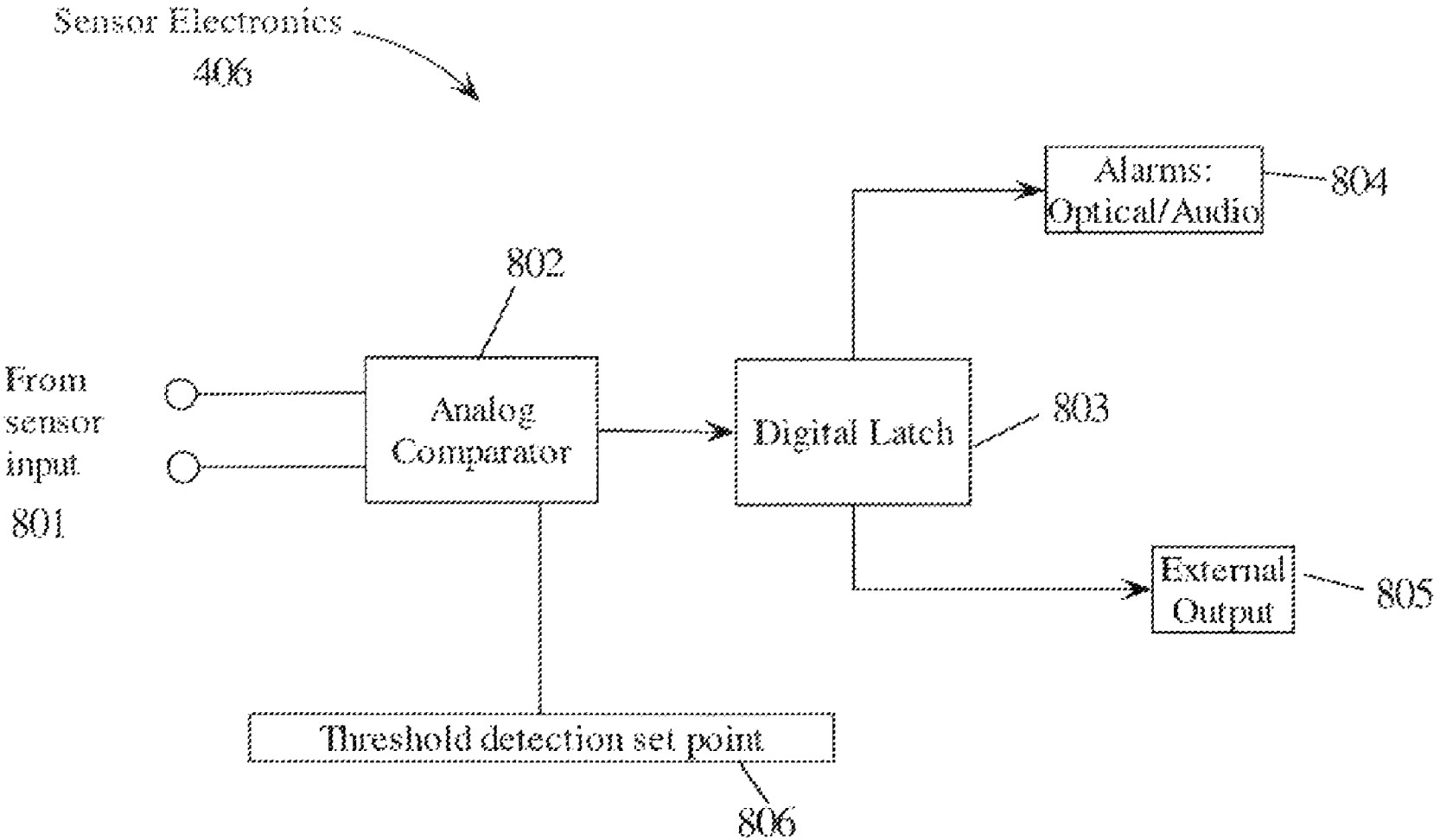
FIG. 8 illustrates sensor electronics for a smoke detector.
Figure 9:
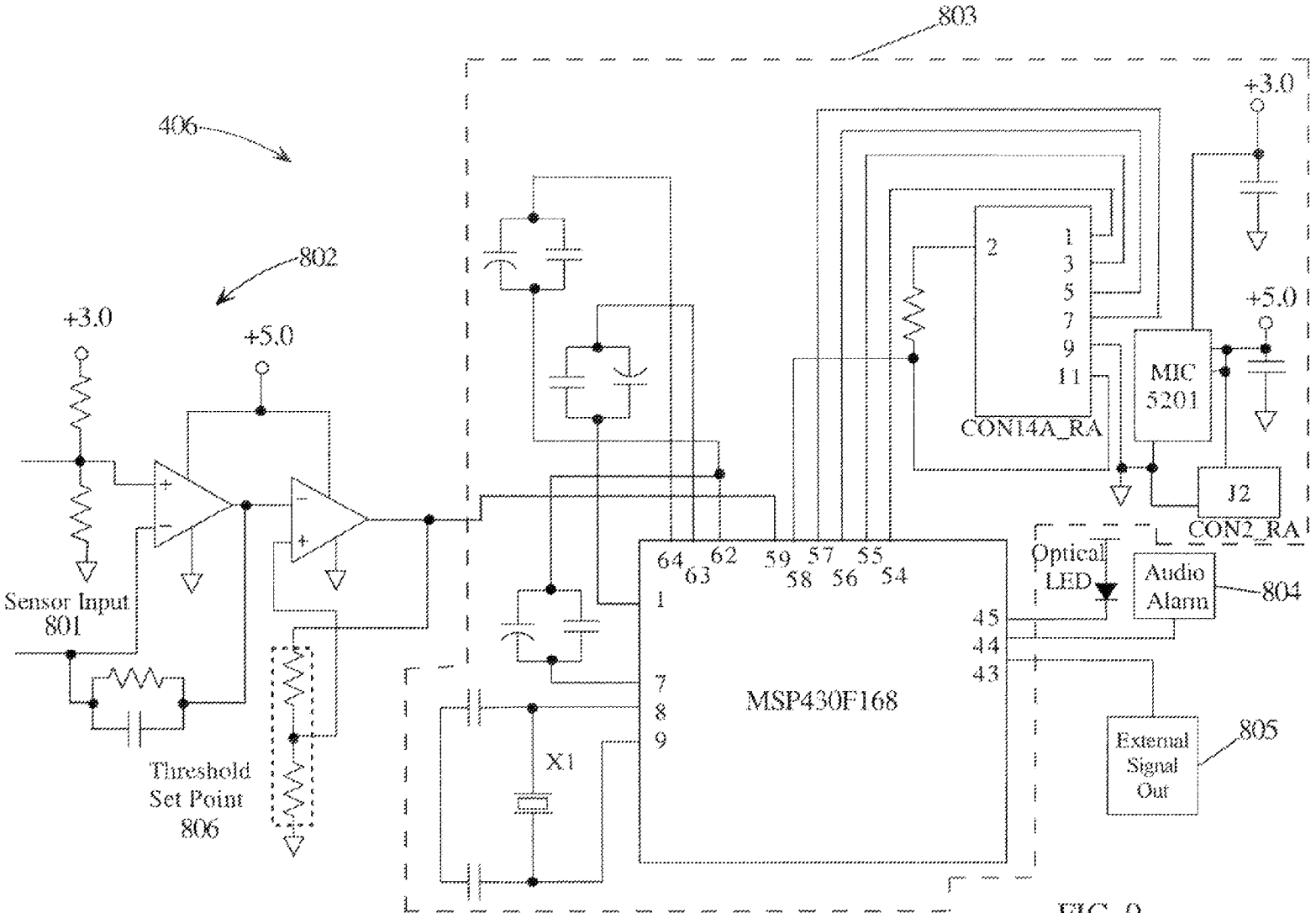
FIG. 9 illustrates electronic circuitry for a smoke detector.
Figure 10:
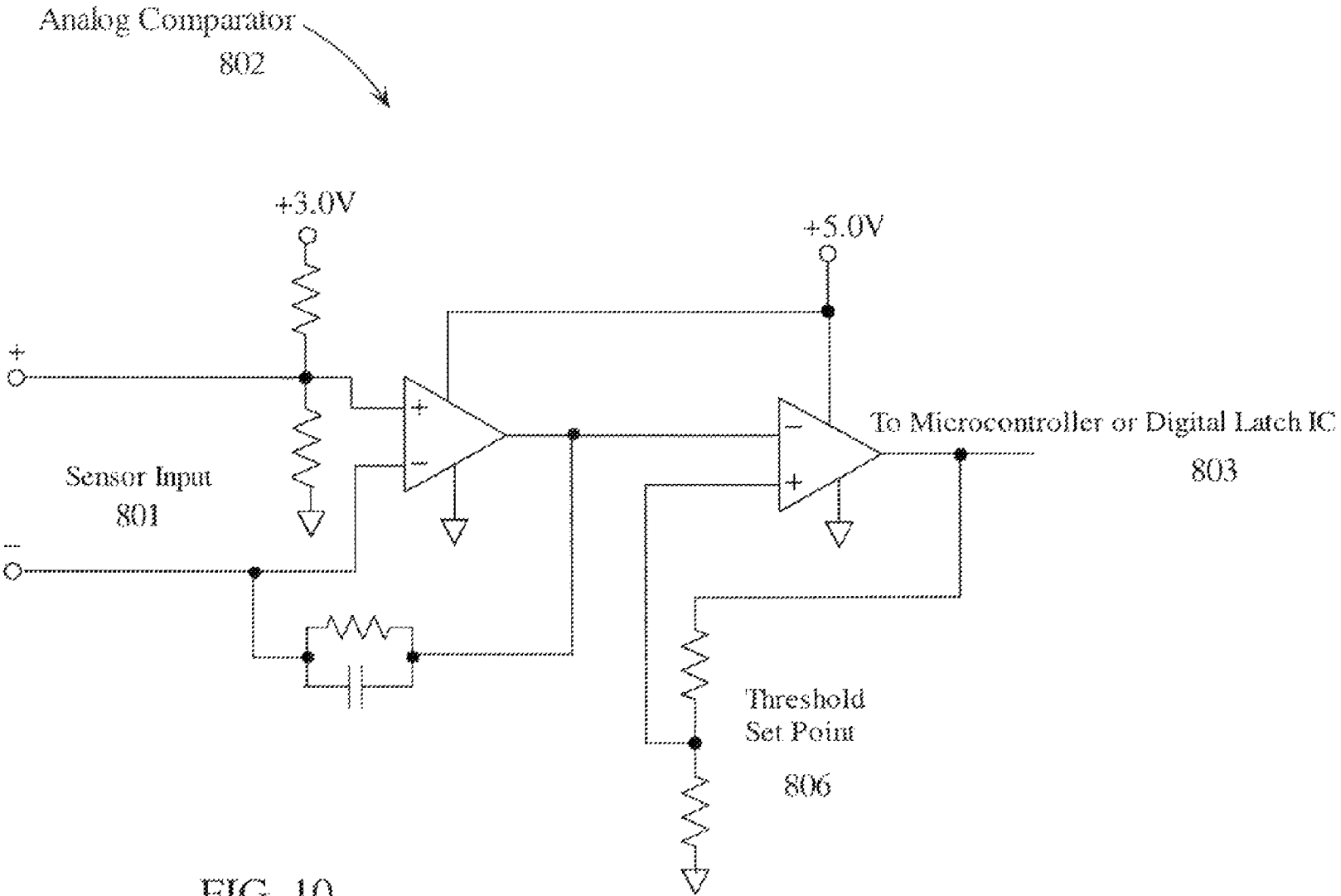
FIG. 10 illustrates an analog comparator.
Figure 11:
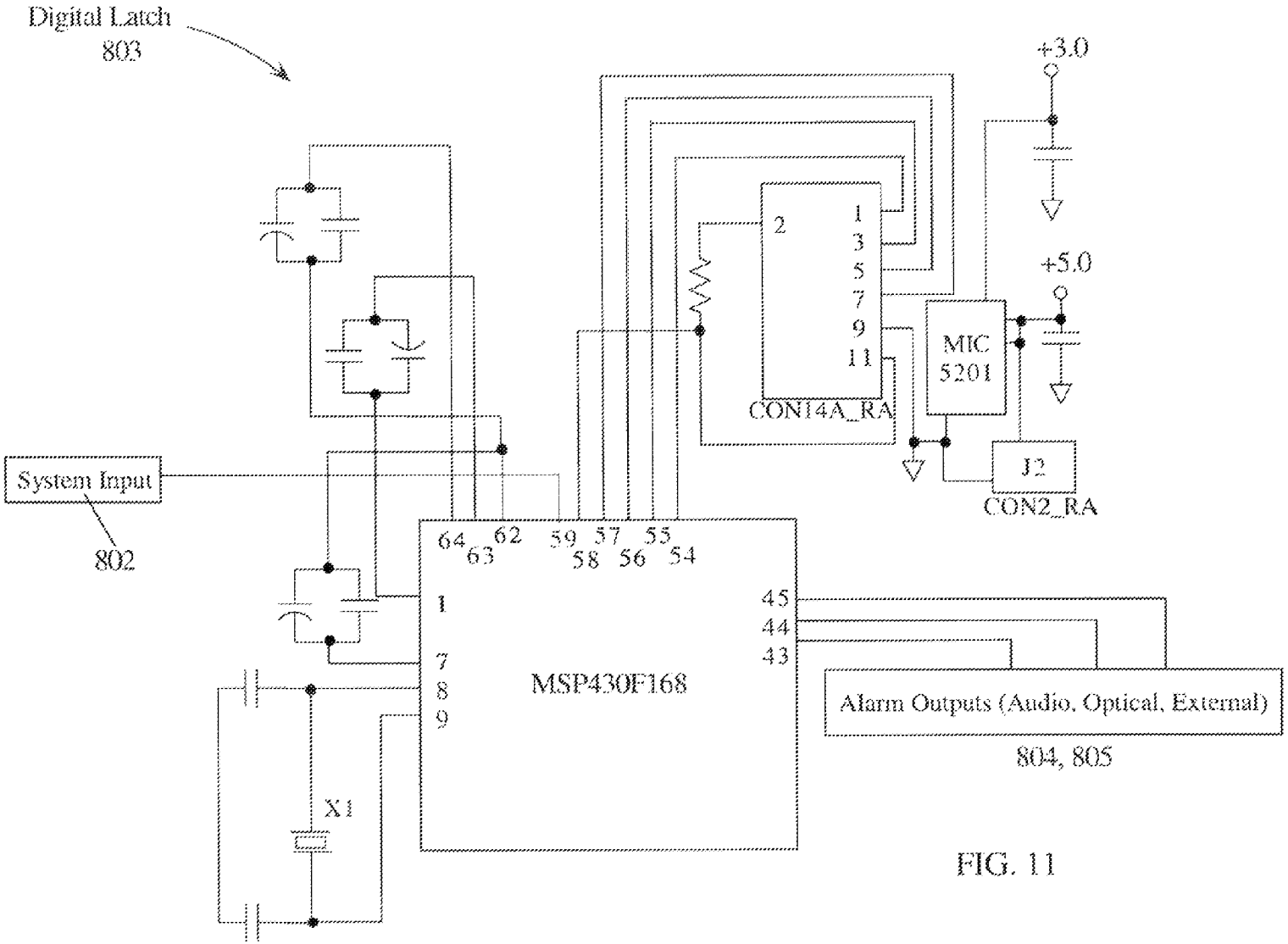
FIG. 11 illustrates a digital latch.

FIG. 8 illustrates a block diagram of sensor electronics 406 that may be utilized within each of the embodiments illustrated in FIGS. 4, 5, 6A, 6B. 7 and 11. FIG. 9 illustrates a detailed circuit diagram of the sensor electronics of FIG. 8. FIG. 10 illustrates a detailed circuit diagram of the analog comparator 802 within the sensor electronics 406. FIG. 1 illustrates a detailed circuit diagram of the digital latch 803 of the sensor electronics 406. As can be seen from FIGS. 8-11, any of the embodiments of the smoke detector described above may be coupled to the sensor electronics 406 at the sensor inputs 801. An alarm 804 or some other type of external output 805 may be the result for output from the sensor electronics 406 when a threshold current level is detected at senor input 801, as predetermined by a threshold detection set point 806. A further description of the sensor electronics 406, including the component parts of the analog comparator 802 and digital latch 803 are not further described herein for reasons of brevity. The sensor electronics 406 are to be designed to receive an input from a smoke detector using CNT coatings, as described herein, and provide an appropriate output in order to make the smoke detector practically effective. The design of such sensor electronics is not pertinent to an understanding of the present invention. Other sensor electronics may be substituted in order to arrive at the same result.

Figure 12:
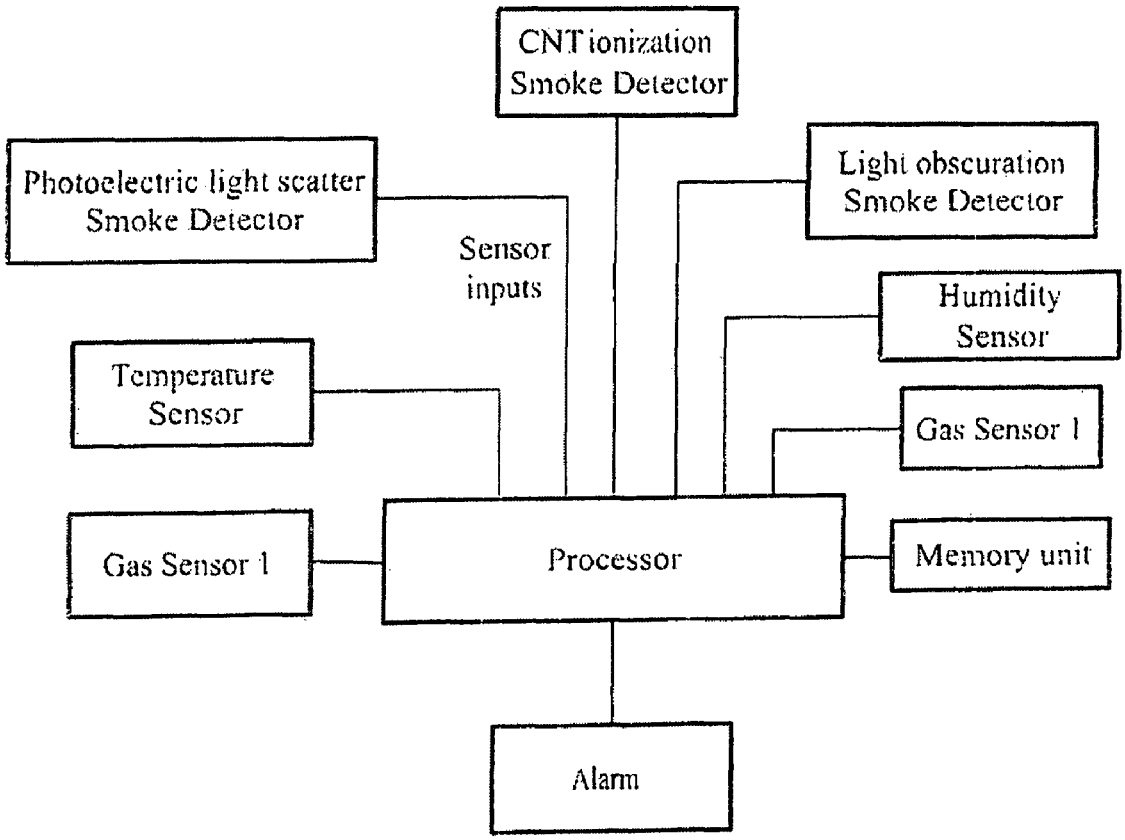
FIG. 12 illustrates an alternative embodiment of the present invention.

FIG. 12 illuminates a combination smoke detector that combines the CNT-based ionization smoke detector (see FIGS. 4. 5, 6A, 6B, and 7) with one or more other sensors or smoke detector technologies. Some fires give off gases as incipient indicators of a fire. The smoke from the fire may be different depending on what is burning. Some fires give off heavy black smoke; other fires may give of a gray smoke or very little at all. The combination of tie different sensors will help sense a fire faster while at the same time lower the chances of a false alarm. The combination sensor will also have the lo possibility of determining what kind of fire is present and relay this information to 911 or a subscription security service.

A number of embodiments of the invention have been described. Nevertheless, it will be understood that various modifications may be made without departing from the spirit and scope of the invention.

What is claimed:

1. A smoke detector comprising:

a field emitter material positioned on a first substrate;

an electric field operable for activating the field emitter material to emit electrons into a passageway;

a sensor with electrodes positioned relative to the passageway and operable to sense ions created by the emitted electrons; and a signal coupled to the sensor that is generated when a current created by the ions passes a predetermined threshold level.

2. The smoke detector as recited in claim 1, wherein the signal is generated when the current created by the ions falls below the predetermined threshold level when smoke particles enter the passageway.

3. The smoke detector as recited in claim 1, wherein the field emitter material comprises carbon nanotubes.

4. The smoke detector as recited in claim 1, wherein the substrate is in a form of a grid with holes formed therein through which a gas to be sensed is allowed to pass.

5. The smoke detector as recited in claim 4, further comprising multiple grids on which the field emitter material is positioned, each such grid having holes formed therein through which the gas to be sensed is allowed to pass.

6. A smoke detector comprising:

a first substrate with a first conductor layer deposited thereon, and a second conductor layer deposited thereon, the first and second conductor layers electrically separated from each other;

a first field emitter material deposited on the first conductor layer, but not on the second conductor layer;

a second substrate with a third conductor layer deposited thereon, and a fourth conductor layer deposited thereon, the third and fourth conductor layers electrically separated from each other;

a second field emitter material deposited on the third conductor layer, but not on the fourth conductor layer;

a voltage source with one electrode coupled to the first and third conductor layers, and a second electrode coupled to the second and fourth conductor layers, the one and second electrodes having opposite polarities from each other;

a sensor with electrodes positioned relative to a passageway and operable to sense ions created by electrons emitted by the first and second field emitter materials into the passageway; and a signal coupled to the sensor that is generated when a current created by the ions passes a predetermined threshold level.

7. The smoke detector as recited in claim 6, wherein the signal is generated when the current created by the ions falls below the predetermined threshold level when smoke particles enter the passageway.

8. The smoke detector as recited in claim 6, wherein the field emitter material comprises carbon nanotubes.

9. The smoke detector as recited in claim 6, wherein the substrate is in a form of a grid with holes formed therein through which a gas to be sensed is allowed to pass.

10. The smoke detector as recited in claim 9, further comprising multiple grids on which the field emitter material is positioned, each such grid having holes formed therein through which the gas to be sensed is allowed to pass.

11. The smoke detector as recited in claim 6, wherein the first and second substrates are in forms of longitudinal wires.

12. A smoke detector comprising:

a field emitter material positioned on a first substrate;

an electric field operable for biasing the field emitter material to pull electrons from a gas present in a passageway;

a sensor with electrodes positioned relative to the passageway and operable to sense ions created by the pulled electrons; and a signal coupled to the sensor that is generated when a current created by the ions passes a predetermined threshold level.

13. The smoke detector as recited in claim 12, wherein the signal is generated when the current created by the ions falls below the predetermined threshold level when smoke particles enter the passageway and absorb the ions.

14. The smoke detector as recited in claim 13, wherein the substrate is in a form of a grid with holes formed therein through which a gas to be sensed is allowed to pass.

15. The smoke detector as recited in claim 14, further comprising multiple grids on which the field emitter material is positioned, each such grid having holes formed therein through which the gas to be sensed is allowed to pass.

16. The smoke detector as recited in claim 12, wherein the field emitter material comprises carbon nanotubes.

17. A smoke detector comprising:

a first substrate with a first conductor layer deposited thereon, and a second conductor layer deposited thereon, the first and second conductor layers electrically separated from each other;

a first field emitter material deposited on the first conductor layer, but not on the second conductor layer;

a second substrate with a third conductor layer deposited thereon, and a fourth conductor layer deposited thereon, the third and fourth conductor layers electrically separated from each other;

a second field emitter material deposited on the third conductor layer, but not on the fourth conductor layer;

a voltage source with one electrode coupled to the first and third conductor layers, and a second electrode coupled to the second and fourth conductor layers, the one and second electrodes having opposite polarities from each other;

a sensor with electrodes positioned relative to a passageway and operable to sense ions created by electrons pulled by the first and second field emitter materials from the passageway; and a signal coupled to the sensor that is generated when a current created by the ions passes a predetermined threshold level.

18. The smoke detector as recited in claim 17, wherein the signal is generated when the current created by the ions falls below the predetermined threshold level when smoke particles enter the passageway and absorb the ions.

19. The smoke detector as recited in claim 18, wherein the field emitter material comprises carbon nanotubes.

20. The smoke detector as recited in claim 19, wherein the substrate is in a form of a grid with holes formed therein through which a gas to be sensed is allowed to pass.

21. A method for detecting particles in a gas comprising:

activating an electric field on a field emitter material to emit electrons into a passageway containing the gas;

sensing a change in current in electrodes positioned in proximity to the passageway, the change in current created by ions produced by the emitted electrons; and activating a signal when the current passes a predetermined threshold level.

22. The method as recited in claim 21, wherein the signal is generated when the current falls below the predetermined threshold level when smoke particles enter the passageway.

23. The method as recited in claim 21, wherein the field emitter material comprises carbon nanotubes.

24. A method comprising:

biasing a field emitter material to pull electrons from a gas present in a passageway;

sensing a change in current in electrodes positioned in proximity to the passageway, the change in current created by ions produced by the pulled electrons; and activating a signal when the current passes a predetermined threshold level.

25. The method as recited in claim 24, wherein the signal is generated when the current falls below the predetermined threshold level when smoke particles enter the passageway and absorb the ions.

26. The method as recited in claim 24, wherein the field emitter material comprises carbon nanotubes.

* * * * *